US010890859B2

(12) United States Patent
Yoshii

(10) Patent No.: US 10,890,859 B2
(45) Date of Patent: Jan. 12, 2021

(54) DEVELOPING DEVICE AND IMAGE FORMING APPARATUS

(71) Applicant: FUJI XEROX CO., LTD., Tokyo (JP)

(72) Inventor: Tomoyuki Yoshii, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/715,891

(22) Filed: Dec. 16, 2019

(65) Prior Publication Data

US 2020/0326642 A1 Oct. 15, 2020

(30) Foreign Application Priority Data

Apr. 11, 2019 (JP) ..... 2019-075602

(51) Int. Cl.
*G03G 15/08* (2006.01)

(52) U.S. Cl.
CPC ..... *G03G 15/0812* (2013.01)

(58) Field of Classification Search
CPC ..... G03G 15/081; G03G 15/0812; G03G 15/0921; G03G 2215/0634
USPC ..... 399/107, 110, 119, 120, 252, 258, 259, 399/284, 286
See application file for complete search history.

(56) References Cited

U.S. PATENT DOCUMENTS 6,701,114 B2 * 3/2004 Sekine ..... G03G 15/0921 399/236
7,003,250 B2 * 2/2006 Sano ..... G03G 15/0812 399/274

FOREIGN PATENT DOCUMENTS

JP 02-120763 * 5/1990
JP 02-284162 A 11/1990

* cited by examiner

*Primary Examiner* — Hoan H Tran
(74) *Attorney, Agent, or Firm* — Sughrue Mion, PLLC

(57) ABSTRACT

A developing device includes a developer carrier configured to carry a developer to be supplied to an image carrier on which an electrostatic latent image is to be formed, a conveying unit configured to convey the developer containing a toner and a carrier, a regulating member configured to regulate the developer carried by the developer carrier to a specified amount, a developer accumulating member disposed upstream of the regulating member in a rotation direction of the developer carrier, the developer accumulating member forming an accumulating portion in which the developer accumulates, and a rotation member disposed between the developer accumulating member and the developer carrier, the rotation member being rotated to allow the developer to pass through a space between the developer accumulating member and the rotation member.

5 Claims, 4 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2019-075602 filed Apr. 11, 2019.

BACKGROUND

(i) Technical Field

The present disclosure relates to a developing device and an image forming apparatus.

(ii) Related Art

For example, JP-A-2-284162 discloses a configuration in which a picked up developer is made uniform in an axial direction by a conveying screw which faces a developing roller.

SUMMARY

Here, when an amount of a developer changes in an axial direction of a conveying member during supply of the developer from the conveying member to a developer carrier, a supply amount of the developer varies in the axial direction and an amount of the developer on the developer carrier varies in the axial direction, which may cause a concentration difference.

Aspects of non-limiting embodiments of the present disclosure relate to a developing device and an image forming apparatus that reduces a difference in concentration of a developer in an axial direction of a conveying member compared with a case where a rotation member that is rotated to allow the developer to pass through a space between a developer accumulating member and the rotation member is not provided.

Aspects of certain non-limiting embodiments of the present disclosure address the above advantages anchor other advantages not described above. However, aspects of the non-limiting embodiments are not required to address the advantages described above, and aspects of the non-limiting embodiments of the present disclosure may not address advantages described above.

According to an aspect of the present disclosure, there is provided a developing device includes a developer carrier configured to carry a developer to be supplied to an image carrier on which an electrostatic latent image is to be formed, a conveying unit configured to convey the developer containing a toner and a carrier, a regulating member configured to regulate the developer carried by the developer carrier to a specified amount, a developer accumulating member disposed upstream of the regulating member in a rotation direction of the developer carrier, the developer accumulating member forming an accumulating portion in which the developer accumulates, and a rotation member disposed between the developer accumulating member and the developer carrier, the rotation member being rotated to allow the developer to pass through a space between the developer accumulating member and the rotation member.

BRIEF DESCRIPTION OF THE DRAWINGS

Exemplary embodiment(s) of the present disclosure will be described in detail based on the following figures, wherein:

FIG. 4A shows an example of a rotation member, FIG. 4B shows another example of the rotation member, and FIG. 4C shows an example of magnetic poles of a developing roller.

DETAILED DESCRIPTION

Hereinafter, exemplary embodiments of the present disclosure will be described in detail with reference to the accompanying drawings.

Figure 1:
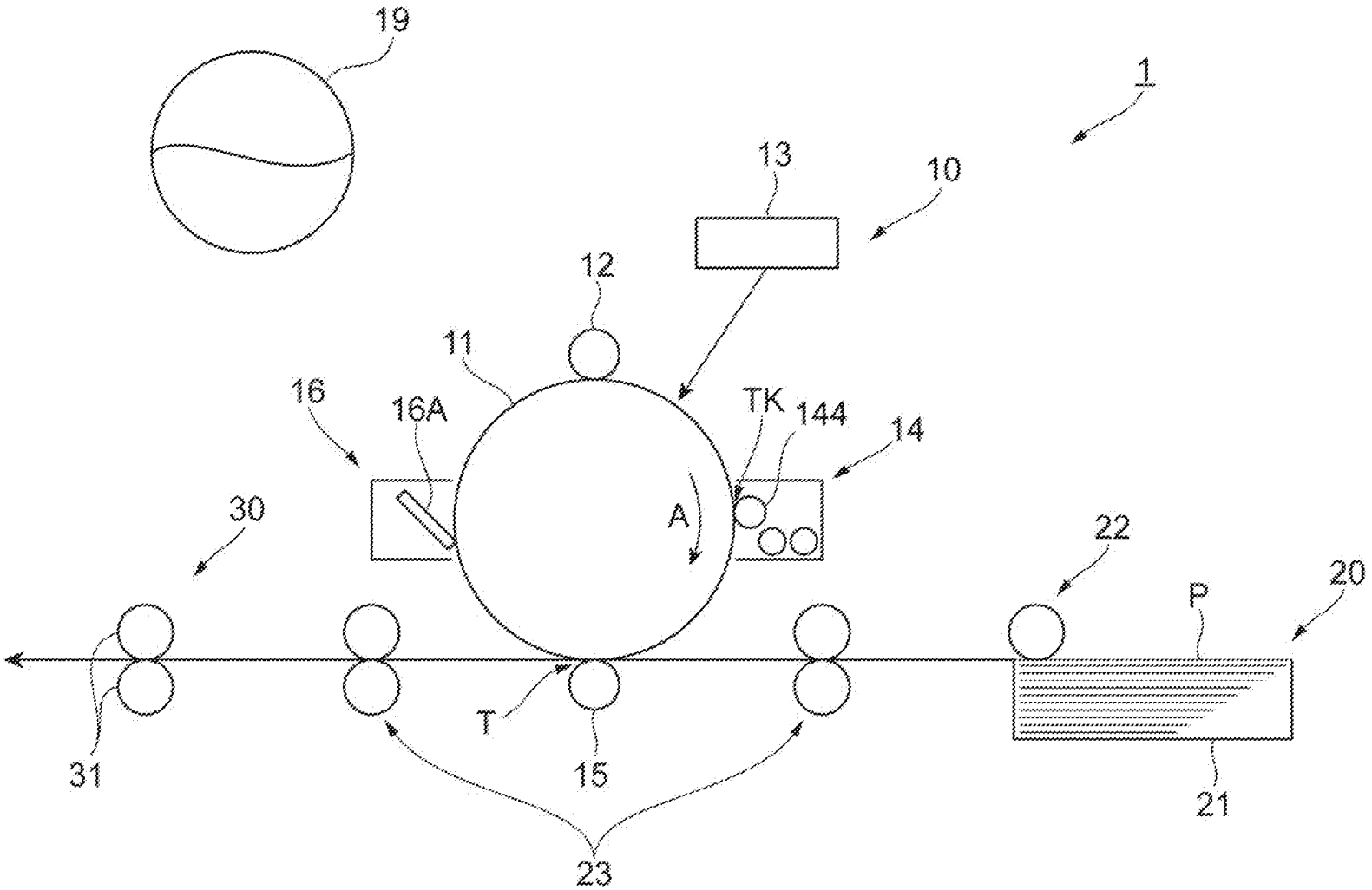
FIG. 1 is a view showing a configuration of an image forming apparatus to which an exemplary embodiment is applied.

FIG. 1 is a view showing an overall configuration of an image forming apparatus 1. In addition, FIG. 1 is a view of the image forming apparatus 1 when viewed from a front side of the image forming apparatus 1.

The image forming apparatus 1 includes an image forming unit 10, a paper feeding unit 20, and a fixing unit 30.

The image forming unit 10 forms a toner image on a paper P using an electrophotographic method. The paper P is an example of a recording material. The paper feeding unit 20 feeds the paper P to the image forming unit 10. The fixing unit 30 fixes, onto the paper P, an image, that is, the toner image formed on the paper P by the image forming unit 10.

The image forming unit 10 includes a photoconductor drum 11 that is rotated in a direction indicated by an arrow A. The image forming unit 10 further includes a charging roller 12, an exposure device 13, a developing device 14, a transfer roller 15, and a cleaning device 16.

The photoconductor drum 11 is an example of an image carrier. The photoconductor drum 11 includes a cylindrical body. A photosensitive layer (not shown) is formed on a surface of the cylindrical body.

The charging roller 12 includes a conductive rubber roller or the like. The charging roller 12 charges the photoconductor drum 11.

The exposure device 13 irradiates the photoconductor drum 11 charged by the charging roller 12 with light from a light source such as a laser light source or a Light emitting diode (LED) to form an electrostatic latent image on a surface of the photoconductor drum 11.

The developing device 14 is an example of a developing unit. The developing device 14 causes toner to adhere onto the surface of the photoconductor drum 11, to develop the electrostatic latent image formed on the photoconductor drum 11 with the toner of a predetermined color. Accordingly, the toner image is formed on the surface of the photoconductor drum 11 in the present exemplary embodiment.

The developing device 14 contains a developer. The developer in the present exemplary embodiment includes a magnetic carrier and colored toner. That is, the developer is a so-called two-component developer.

Further, a developer container 19 is provided in the present exemplary embodiment. The developer container 19 contains the developer to be supplied to the developing device 14. In the present exemplary embodiment, a new developer is supplied from the developer container 19 to the developing device 14 through a developer conveying path (not shown).

The transfer roller 15 is an example of a transfer unit. The transfer roller 15 includes a conductive rubber roller and the like.

In the present exemplary embodiment, a portion where the transfer roller 15 and the photoconductor drum 11 face each other is a transfer portion T. The toner image on the surface of the photoconductor drum 11, that is, the toner image carried by the photoconductor drum 11, is transferred to the conveyed paper P in the transfer portion T.

The cleaning device 16 includes a contact member 16A that is in contact with the photoconductor drum 11. The cleaning device 16 removes adhering matters such as the toner on the photoconductor drum 11.

In the present exemplary embodiment, the transfer roller 15 performs transfer onto the paper P, but the present disclosure is not limited thereto. The transfer roller 15 may perform the transfer onto an intermediate transfer belt (not shown).

The paper feeding unit 20 includes a paper container 21 and a sending out mechanism 22. The paper container 21 accommodates sheets of the paper P. The sending out mechanism 22 sends out the paper P from the paper container 21.

Further, a paper conveying mechanism 23 is provided in the present exemplary embodiment. The paper conveying mechanisms 23 conveys the paper P sent out from the paper feeding unit 20 via the transfer portion T and the fixing unit 30.

The fixing unit 30 is an example of a fixing unit. The fixing unit 30 includes a pair of rotation bodies 31 that are rotated while being in contact with each other.

A heating source (not shown) is provided inside one of the rotation bodies 31.

In the fixing unit 30, the two rotation bodies 31 press and heat the paper P, so that the toner image on the paper P is fixed on the paper P.

An image forming operation in the image forming apparatus 1 will be described.

In the image forming unit 10, the photoconductor drum 11 that is rotated in the direction of the arrow A is charged by the charging roller 12. Next, the exposure device 13 performs exposure, and an electrostatic latent image corresponding to image information is formed on the surface of the photoconductor drum 11.

Thereafter, the developing device 14 performs development, and a toner image corresponding to the electrostatic latent image is formed on the surface of the photoconductor drum 11.

The toner image formed on the photoconductor drum 11 is carried to the transfer portion T along with the rotation of the photoconductor drum 11. The paper P sent out from the paper feeding unit 20 is conveyed to the transfer portion T by the paper conveying mechanism 23.

Then, the toner image on the photoconductor drum 11 is transferred onto the conveyed paper P by the transfer portion T. Thereafter, the paper P onto which the toner image is transferred is heated and pressed while passing through the fixing unit 30, and the toner image is fixed on the paper P.

Figure 2:
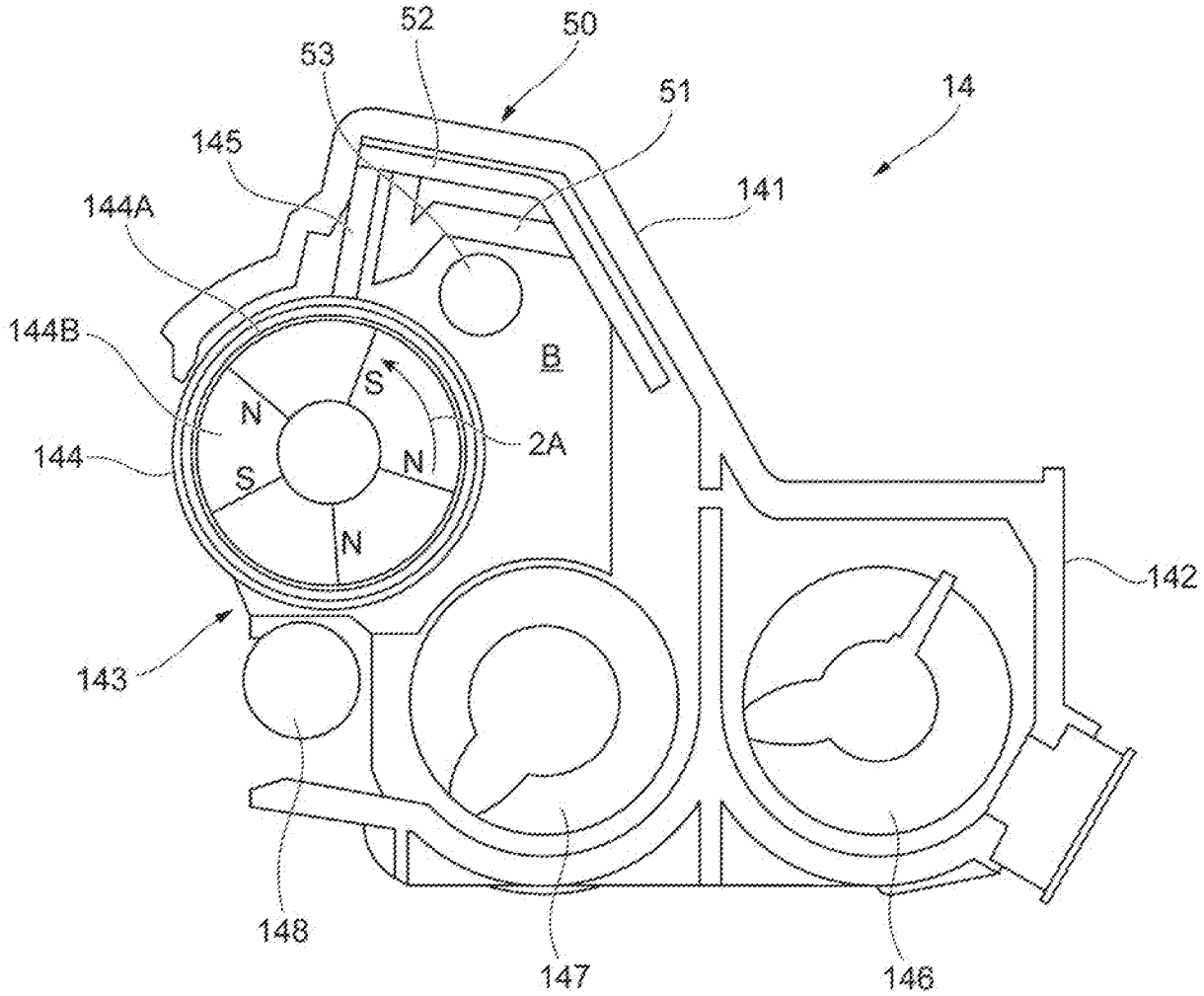
FIG. 2 is a view illustrating a developing device.

FIG. 2 is a view showing the developing device 14.

The developing device 14 includes a container portion 141 that contains a developer (not shown) therein. The container portion 141 is formed of a container case 142 made of resin.

The container case 142 of the developing device 14 extends in a direction orthogonal to a paper surface of FIG. 2 that is a direction directed from a front side to a rear side of the image forming apparatus 1 (see FIG. 1). The container case 142 includes a rear end portion (not shown) on the rear side thereof, and a front end portion (not shown) on the front side thereof.

The container case 142 is formed with an opening 143 at a position where the opening 143 faces the photoconductor drum 11 (see FIG. 1). A developing roller 144 is provided in the opening 143. The developing roller 144 that causes the developer to adhere to the surface of the photoconductor drum 11.

The developing roller 144 is an example of a developer carrier. The developing roller 144 is formed in a columnar shape and extends in a direction from the front side to the rear side of the image forming apparatus 1. In addition, the developing roller 144 is disposed along a longitudinal direction of the developing device 14.

The developing roller 144 includes a developing sleeve 144A and a magnet roller 144B. The developing sleeve 144A includes a cylindrical body and is driven to rotate. The magnet roller 144B is disposed inside the developing sleeve 144A.

The developing sleeve 144A is made of, for example, metal such as SUS. The developing sleeve 144A is rotated in a direction of an arrow 2A in FIG. 2.

The magnet roller 144B includes five magnetic poles arranged along a circumferential direction of the magnet roller 144B.

Further, in the present exemplary embodiment, the developing sleeve 144A and the photoconductor drum 11 rotate such that the developing sleeve 144A and the photoconductor drum 11 move in the same direction at a facing portion TK (see FIG. 1) where the developing roller 144 faces the photoconductor drum 11.

The developing device 14 includes a layer regulating member 145 that regulates a layer thickness of a developer carried by the developing roller 144. The layer regulating member 145 is made of metal. The layer regulating member 145 is an example of a regulating member that regulates the developer to a specified amount.

As shown in FIG. 2, the developing device 14 includes a first conveying member 146 and a second conveying member 147 each having a spiral portion that conveys the developer.

The first conveying member 146 and the second conveying member 147 are an example of a conveying unit. The first conveying member 146 and the second conveying member 147 are opposite to the photoconductor drum 11 (see FIG. 1) across the developing roller 144.

The first conveying member 146 includes a rotation shaft along a rotation shaft of the developing sleeve 144A that is driven to rotate. The first conveying member 146 is rotated around the rotation shaft to convey the developer in the container portion 141.

In the developing device 14 configured in such way, the new two-component developer supplied from the developer container 19 (see FIG. 1) is circulated and conveyed by being agitated and conveyed between the first conveying member 146 and the second conveying member 147. More specifically, the developer agitated by the first conveying member 146 may be agitated by the second conveying member 147 and further agitated by the first conveying member 146. A circulation path is formed in the developing device 14. The circulation path is a path in which the toner is circulated in the axial direction by rotation of the first conveying member 146 and the second conveying member 147.

As shown in FIG. 2, the developing device 14 includes a rotation member 148 that is rotated at a position where the rotation member 148 is in contact with a tip of the developer on the developing roller 144.

The developing roller 144, the layer regulating member 145, the first conveying member 146, the second conveying member 147, and the rotation member 148 are disposed substantially parallel to the photoconductor drum 11 (see FIG. 1).

Next, an accumulating portion 50 in which the developer to be supplied to the developing roller 144 accumulates in the developing device 14 will be described. The accumulating portion 50 is an example of an accumulating portion.

As shown in FIG. 2, the accumulating portion 50 includes a developer accumulating member 51 disposed upstream of the layer regulating member 145 in a rotation direction of the developing roller 144. The developer accumulating member 51 is made of plastic or aluminum. The developer accumulating member 51 is an example of a developer accumulating member.

In the present exemplary embodiment, the developer accumulating member 51 of the accumulating portion 50 is attached to the container case 142 via a mounting member 52 made of metal. The developer accumulating member 51 is formed in a recessed shape so as to ensure a wide space B between the developer accumulating member 51 and the developing roller 144.

Here, the space B may be narrowed so that the developer does not accumulate upstream of the layer regulating member 145. However, flowability of the developer tends to decrease due to a reduction in a diameter of the developer along with an increase of image quality. Therefore, when the space B is narrowed, the flowability of the developer is reduced, so that the developer is subjected to excessive stress, which may result in that (i) a coating on a surface of a carrier is peeled off and the surface is contaminated, and (ii) an external additive added to a surface of toner is buried on the surface of the toner or is peeled off from the surface of the toner. As a result, the developer may deteriorate, which hinders an implementation of high image quality.

Therefore, in the present exemplary embodiment, the space B is widened, and a rotation member 53 that is rotated by a driving force is provided in the space B. Accordingly, the flowability of the developer accumulated in the space B is prevented from decreasing, the developer is prevented from being subjected to excessive stress and high image quality can be achieved.

The rotation member 53 is an example of a rotation member. The rotation member 53 has a shape extending in a direction of a rotation shaft (that is, a direction perpendicular to the paper surface of FIG. 2). The rotation member 53 is disposed between the developer accumulating member 51 and the developing roller 144. The rotation member 53 is rotated to allow the developer to pass between the developer accumulating member 51 and the rotation member 53. That is, the rotation member 53 is not used to convey the developer in the direction of the rotation shaft, but to create a flow for the developer accumulated in the space B. A shape of the rotation member 53 is not a spiral shape. In this regard, the rotation member 53 has a function different from, for example, those of the first conveying member 146 and the second conveying member 147. The rotation member 53 does not convey the developer in an axial direction thereof, so that a variation in an amount of the developer in the axial direction is prevented.

The rotation member 53 is not in contact with the developer accumulating member 51 but is separated from the developer accumulating member 51. In a case where the rotation member 53 is in contact with the developer accumulating member 51, heat generated by contact would have an influence on the developer. Considering this heat, we adopt the above-described structure. That is, in recent years, toner is melted at a low temperature. If heat is generated by a friction force generated between the rotation member 53 and the developer accumulating member 51, the melted toner may stick to the surface of the developer accumulating member 51, or the toners may stick to each other to generate a toner block, which may lead to a situation in which the toner is aggregated at a narrow portion. In order to prevent occurrence of such a situation, the rotation member 53 is not in contact with the developer accumulating member 51, but there is a gap between the rotation member 53 and the developer accumulating member 51.

The developer accumulating member 51, the mounting member 52, and the rotation member 53 extend in the same direction as the developing roller 144.

The rotation member 53 may be a rod-shaped member that is processed to have irregularities on a circumferential surface or a surface thereof. The processing mentioned above refers to processing that enables the rotation member 53 to easily break an aggregated developer. For example, the processing increases a friction force by sandblasting to roughen the surface or forming a small groove extending in the axial direction.

The rotation member 53 may be rotated at a speed equal to or higher than a rotation speed of the developing roller 144. In terms of improving the flow of a collected developer, the rotation member 53 may rotated in a direction opposite to a rotation direction of the developing roller 144 so as to move in the same direction at a position where the rotation member 53 faces the developing roller 144, as the direction in which the developing roller 144 moves.

Figure 3:
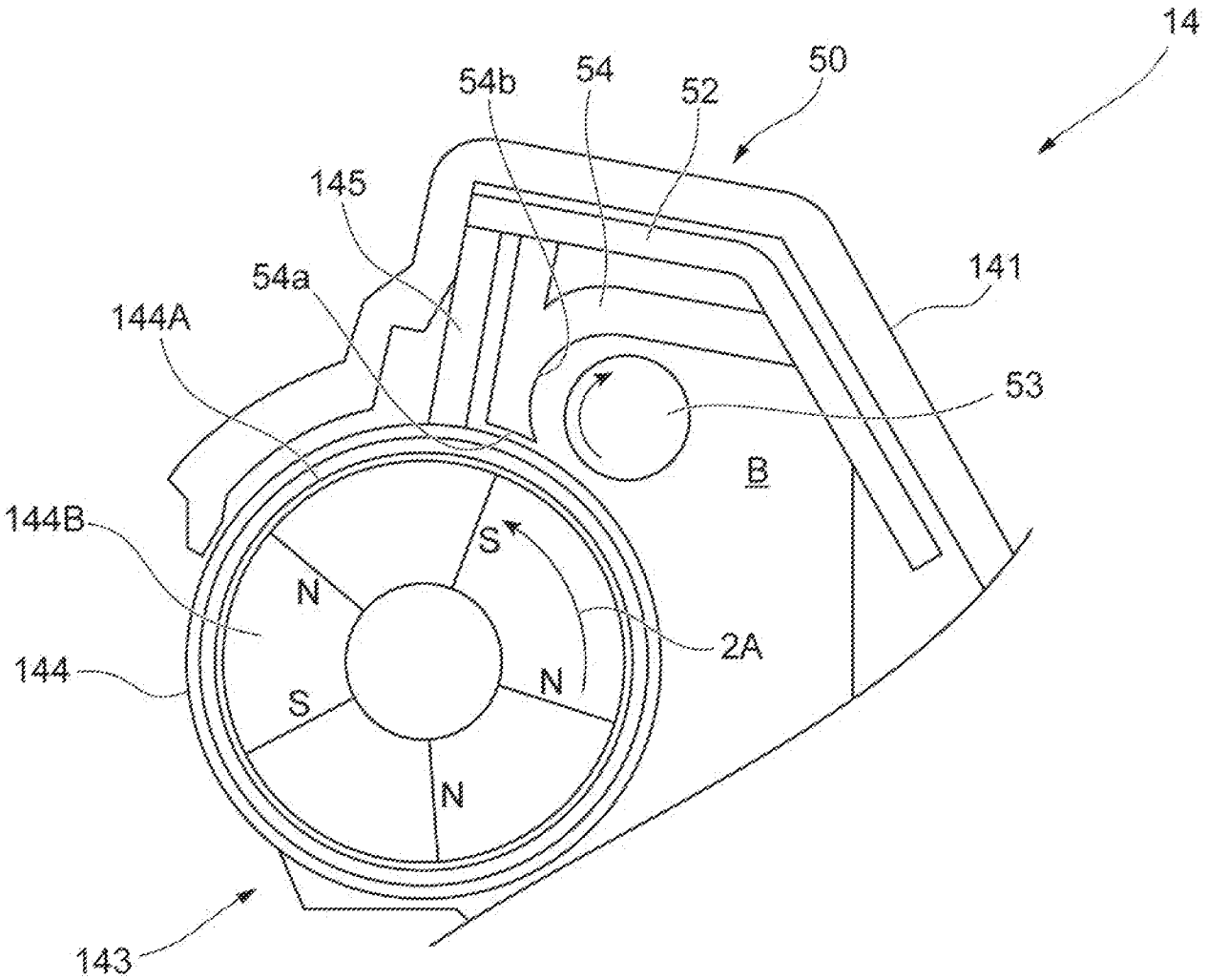
FIG. 3 is a partial view showing a developing device according to a modification.

FIG. 3 is a partial view showing the developing device 14 according to a modification and corresponds to FIG. 2.

The developing device 14 shown in FIG. 3 includes a developer accumulating member 54 different from the developer accumulating member 51 shown in FIG. 2. The developer accumulating member 54 is made of plastic or aluminum. The developer accumulating member 54 is an example of the developer accumulating member.

As shown in FIG. 3, the developer accumulating member 54 has a surface 54*a* substantially parallel to a direction extending in a tangential direction from a position of the developing roller 144 corresponding to the tip of the layer regulating member 145. Since the collected developer tends to grow in the tangential direction from the tip of the layer regulating member 145, the surface 54*a* does not hinder the growth of the collected developer.

The developer accumulating member 54 has an inner peripheral surface 54*b* that is positioned above the surface 54*a*. The inner peripheral surface 54*b* is formed in a concave shape along an outer peripheral surface of the rotation member 53. A space is formed between the inner peripheral surface 54*b* and the rotation member 53. The space allows the collected developer to pass therethrough.

The rotation member 53 is positioned above the surface 54*a* of the developer accumulating member 54. The present disclosure is not limited thereto. The rotation member 53 may be positioned below the surface 54*a*.

Thus, the collected developer that grows along the surface 54*a* of the developer accumulating member 54 passes through the space between the inner peripheral surface 54*b* of the developer accumulating member 54 and the rotation member 53 by the rotation of the rotation member 53 and is returned to the second conveying member 147. In this way, the flowability of the collected developer is recovered or maintained.

Figure 4A:
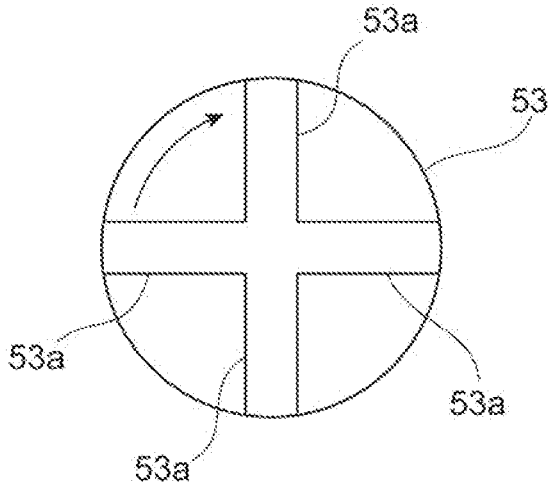
FIGS. 4A to 4C are partial views showing developing devices according to other modifications.
Figure 4B:
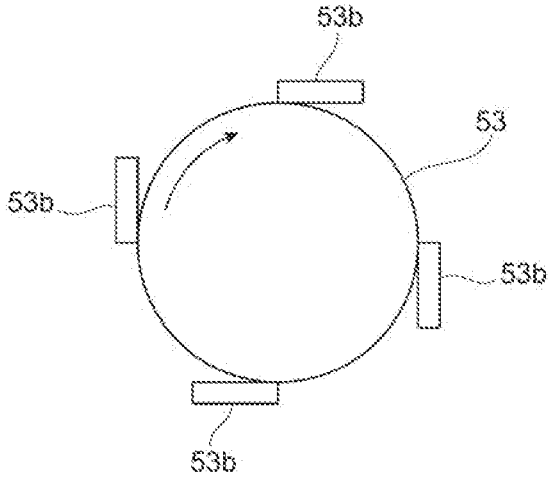
Figure 4C:
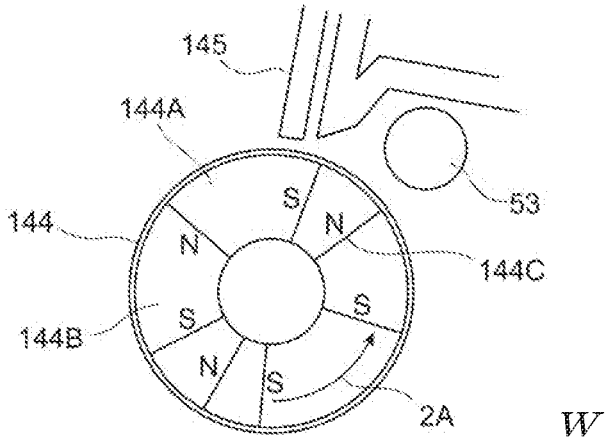

FIGS. 4A to 4C are partial views showing the developing device 14 according to other modifications. FIG. 4A shows an example of the rotation member 53, FIG. 4B shows another example of the rotation member 53, and FIG. 4C shows an example of the magnetic poles of the developing roller 144.

The rotation member 53 shown in FIG. 4A is formed in a paddle shape or a windmill shape and includes four paddles 53*a* extending in a radial direction from a rotation center thereof. The paddle 53*a* is an example of a radially extending portion that extends in the radial direction on a transverse plane thereof.

The rotation member 53 shown in FIG. 4B includes a circular member having a rotation axis. The rotation member 53 is formed in a blade shape and includes four blade members 53*b* each extending in a tangential direction of a circumferential surface of the circular member. The blade members 53*b* protrude from the circumference of the circular member. The blade member 53*b* is an example of a circumferentially extending portion that extends in the circumferential direction on the transverse plane thereof.

Providing the paddles 53*a* or the blade members 53*b* further flows the collected developer accumulated in the space B, through between the rotation member 53 and the developer accumulating member 54.

FIGS. 4A and 4B respectively show that the rotation member 53 includes the four paddles 53*a* and that the rotation member 53 includes the four blade members 53*b*. The present disclosure is not limited to these modifications. The number of paddles 53*a* and the number of blade members 53*b* may be number other than four.

The developing roller 144 shown in FIG. 4C includes an additional magnetic pole 144C that is added to the developing roller 144 shown in FIG. 2. The additional magnetic pole 144C is provided at a position where the developing roller 144 faces the rotation member 53. In other words, the developing roller 144 is positioned in a projection region of the rotation member 53 onto the developing roller 144.

Since the additional magnetic pole 144C is provided at such a position, the developer carried by the developing roller 144 receives a magnetic force from the additional magnetic pole 144C to form magnetic brush. The position of the additional magnetic pole 144C is separated from the layer regulating member 145. The developer on the developing roller 144 forms a magnetic brush at such a position, and a tip of the developer comes into contact with the rotation member 53, so that an amount of the developer regulated by the layer regulating member 145 can be reduced. Accordingly, the amount of the developer aggregated near the layer regulating member 145 is reduced.

The exemplary embodiment adopts the configuration in which the regulating member is disposed above the developing roller 144 (see FIG. 2). The present disclosure is not limited thereto. The regulating member may be disposed below the developing roller. In addition, each member of the present exemplary embodiment may be formed of a single component or may be formed of plural components.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer carrier configured to carry a developer to be supplied to an image carrier on which an electrostatic latent image is to be formed;

a conveying unit configured to convey the developer containing a toner and a carrier;

a regulating member configured to regulate the developer carried by the developer carrier to a specified amount;

a developer accumulating member disposed upstream of the regulating member in a rotation direction of the developer carrier, the developer accumulating member forming an accumulating portion in which the developer accumulates; and a rotation member disposed between the developer accumulating member and the developer carrier, the rotation member being rotated to allow the developer to pass through a space between the developer accumulating member and the rotation member, wherein the rotation member has a shape extending in a direction of a rotation axis of the rotation member, and the shape is not a spiral shape, and wherein a shape of the rotation member includes one of a paddle shape and includes a plurality of radially extending portions that extend in a radial direction on a transverse plane thereof, a blade shape including a plurality of circumferentially extending portions that extend in a circumferential direction on a transverse plane thereof, or a rod-shaped member that has irregularities on a surface thereof.

2. The developing device according to claim 1, wherein the rotation member is rotated in a direction opposite to a rotation direction of the developer carrier.

3. A developing device comprising:

a developer carrier configured to carry a developer to be supplied to an image carrier on which an electrostatic latent image is to be formed;

a conveying unit configured to convey the developer containing a toner and a carrier;

a regulating member configured to regulate the developer carried by the developer carrier to a specified amount;

a developer accumulating member disposed upstream of the regulating member in a rotation direction of the developer carrier, the developer accumulating member forming an accumulating portion in which the developer accumulates; and a rotation member disposed between the developer accumulating member and the developer carrier, the rotation member being rotated to allow the developer to pass through a space between the developer accumulating member and the rotation member, wherein the rotation member has a shape extending in a direction of a rotation axis of the rotation member, the shape is not a spiral shape, and the rotation member is rotated at a speed equal to or higher than a rotation speed of the developer carrier.

4. A developing device comprising:

a developer carrier configured to carry a developer to be supplied to an image carrier on which an electrostatic latent image is to be formed;

a conveying unit configured to convey the developer containing a toner and a carrier;

a regulating member configured to regulate the developer carried by the developer carrier to a specified amount;

a developer accumulating member disposed upstream of the regulating member in a rotation direction of the developer carrier, the developer accumulating member forming an accumulating portion in which the developer accumulates; and a rotation member disposed between the developer accumulating member and the developer carrier, the rotation member being rotated to allow the developer to pass through a space between the developer accumulating member and the rotation member, wherein a position of the rotation member is defined by a relationship between magnetic poles of the developer carrier and the rotation member.

5. The developing device according to claim 4, wherein the magnetic poles of the developer carrier are positioned in a projection region of the rotation member to the developer carrier.

* * * * *